US011154174B2

(12) United States Patent
Xu et al.

(10) Patent No.: US 11,154,174 B2
(45) Date of Patent: Oct. 26, 2021

(54) CLEANING DEVICE AND ROLLER BRUSH COMPONENT

(71) Applicant: MIDEA ROBOZONE TECHNOLOGY CO., LTD., Suzhou (CN)

(72) Inventors: Xiaowei Xu, Suzhou (CN); Yuan Chen, Suzhou (CN); Xianmin Wei, Suzhou (CN); Daming Shen, Suzhou (CN)

( * ) Notice: Subject to any disclaimer, the term of this patent is extended or adjusted under 35 U.S.C. 154(b) by 161 days.

(21) Appl. No.: 16/719,988

(22) Filed: Dec. 19, 2019

(65) Prior Publication Data

US 2020/0196816 A1 Jun. 25, 2020

(30) Foreign Application Priority Data

Dec. 24, 2018 (CN) ..... 201822175755.1

(51) Int. Cl.
*A47L 11/40* (2006.01)
*A47L 11/18* (2006.01)

(52) U.S. Cl.
CPC ..... *A47L 11/4052* (2013.01); *A47L 11/4011* (2013.01); *A47L 11/4055* (2013.01); *A47L 11/4058* (2013.01); *A47L 11/4063* (2013.01); *A47L 11/18* (2013.01); *A47L 11/4041* (2013.01); *A47L 2201/06* (2013.01)

(58) Field of Classification Search
CPC ..... A47L 11/4011; A47L 11/4041; A47L 11/4052; A47L 11/4055; A47L 11/4058; A47L 11/4063; A47L 11/4066; A47L 11/4069; A47L 2201/06
USPC ..... 15/41.1, 52, 52.1, 82
See application file for complete search history.

(56) References Cited

U.S. PATENT DOCUMENTS

2002/0124334 A1* 9/2002 Worwag ..... A47L 9/0416 15/52.1
2006/0282965 A1* 12/2006 Basham ..... A47L 11/4011 15/52.1
2018/0338656 A1 11/2018 Carter et al.

FOREIGN PATENT DOCUMENTS

DE 3542631 A1 6/1987
DE 102011055964 * 5/2013

* cited by examiner

*Primary Examiner* — Mark Spisich
(74) *Attorney, Agent, or Firm* — Kilpatrick Townsend & Stockton, LLP

(57) ABSTRACT

The embodiments of the present application provide a cleaning device and a roller brush component. The roller brush component includes a mounting base, a roller brush frame, an adjusting mechanism, a first roller brush and a second roller brush. A notch is formed on one side of the mounting base. The roller brush frame is rotatablely connected with the mounting base. The adjusting mechanism is in driving connection with the roller brush frame to drive the roller brush frame to rotate. The first roller brush and the second roller brush are connected with the roller brush frame, and the roller brushes are positioned in the notch. The roller brush frame, the first roller brush and the second roller brush are configured such that the first roller brush and the second roller brush may have different ground clearances during rotation of the roller brush frame.

15 Claims, 5 Drawing Sheets

CLEANING DEVICE AND ROLLER BRUSH COMPONENT

CROSS-REFERENCES TO RELATED APPLICATIONS

The present application is based on and claims priority to Chinese patent application number 201822175755.1, filed on Dec. 24, 2018, the entire disclosure of which is hereby incorporated by reference.

FIELD

The present disclosure relates to the field of household appliances, and particularly relates to a cleaning device and a roller brush component thereof.

BACKGROUND

Taking a sweeping robot as an example, it mainly adopts a sweeping mode in which a fan is matched with roller brushes. The roller brushes are divided into a second roller brush and a soft-bristle roller brush, and bristles on the surface of the second roller brush are harder, so that the second roller brush is relatively suitable for clearing carpets and the like; and bristles on the surface of the first roller brush are softer, so that the first roller brush is relatively suitable for clearing floors, ceramic tiles and the like. In related technologies, most of the sweeping robots have a single roller brush, but the single roller brush may only meet one sweeping occasion. When the sweeping occasion needs to be switched, it is necessary to remove the roller brush on the sweeping robot and mount another suitable roller brush, so that the sweeping mode is inconvenient to switch.

SUMMARY

Based on the above, the embodiments of the present application are expected to provide a cleaning device of which the sweeping modes are conveniently switched and a roller brush component thereof.

The embodiments of the present application provide a roller brush component of a cleaning device. The roller brush component includes a mounting base, a roller brush frame, an adjusting mechanism, a first roller brush and a second roller brush. A notch is formed on one side of the mounting base. The roller brush frame is rotatablely connected with the mounting base. The adjusting mechanism is in driving connection with the roller brush frame to drive the roller brush frame to rotate. The first roller brush and the second roller brush are connected with the roller brush frame, and a plurality of the roller brushes are positioned in the notch. The roller brush frame, the first roller brush and the second roller brush are configured such that the first roller brush and the second roller brush have different ground clearances during rotation of the roller brush frame.

Further, the first roller brush and the second roller brush are arranged in parallel, and a center line of rotation of the roller brush frame is parallel to an axis of the first roller brush.

Further, the first roller brush is formed as a hard-bristle roller brush, and the second roller brush is formed as a soft-bristle roller brush.

Further, the adjusting mechanism includes an elastic element and a cam which are positioned at one side of the center line of rotation of the roller brush frame, the elastic element is connected between the roller brush frame and the mounting base, the elastic element applies a torque along a first direction to the roller brush frame, the cam is in sliding contact with the roller brush frame, the cam applies a torque along a second direction to the roller brush frame, and the first direction is opposite to the second direction.

Further, the roller brush component includes a first motor and a first connecting rod, the first connecting rod is in driving connection with the first motor, and the cam is fixedly connected with the first connecting rod.

Further, the elastic element is a spring or a rubber band.

Further, the roller brush frame includes a support beam, two end plates and connecting plates connected between the two end plates, the two end plates are positioned at two axial ends of the roller brush, the support beam is disposed at one side of the end plate away from the notch, a through hole extending along an axial direction of the roller brush is formed in the support beam, the roller brush component includes a connecting shaft, the connecting shaft is penetrated in the through hole, and two axial ends of the connecting shaft are supported on the mounting base.

Further, the adjusting mechanism includes a second motor and a second connecting rod, the second connecting rod is in driving connection with the second motor, and the roller brush frame is fixedly connected with the second connecting rod.

The second aspect of the embodiments of the present application provides a cleaning device. The cleaning device includes any one of the above roller brush components of the cleaning device.

Further, the cleaning device includes a control device and an identification device configured to identify a cleaning environment, the control device is electrically connected with the identification device and the adjusting mechanism, and the control device controls the adjusting mechanism to drive the roller brush frame to rotate according to an identification result of the identification device.

Further, the cleaning device is a sweeping robot.

Taking an example of cleaning floors and carpets, when the floors need to be cleaned, the adjusting mechanism drives the roller brush frame to rotate until the second roller brush is in contact with the ground to use the second roller brush to clean the floors, and this state is a floor sweeping mode; and when the carpets need to be cleaned, the adjusting mechanism drives the roller brush frame to rotate until the first roller brush is in contact with the ground to use the first roller brush to clean the carpets, and this state is a carpet sweeping mode. Therefore, the sweeping modes are conveniently switched without manual replacement operations such as disassembly and installation.

Figure 1:
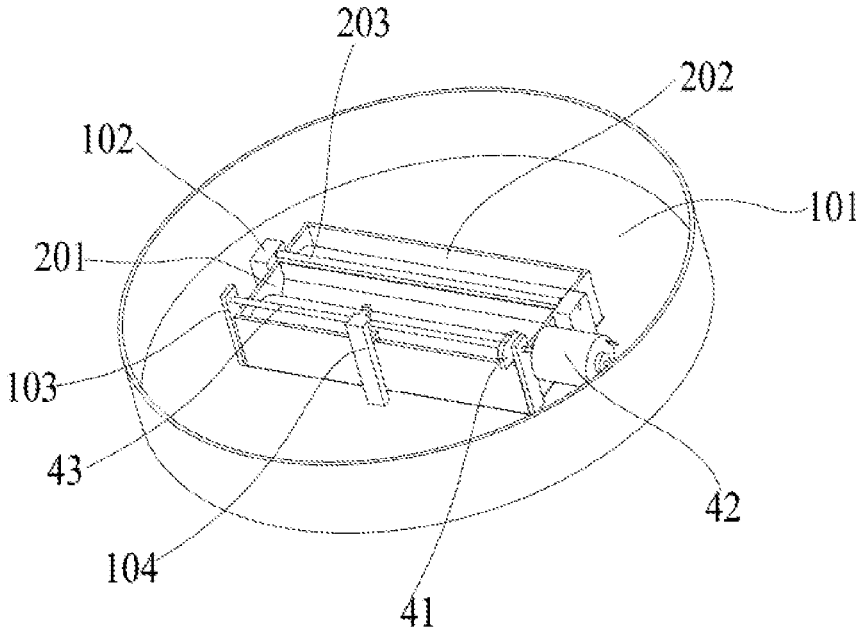
FIG. 1 is a schematic view of a portion of a structure of a cleaning device according to an embodiment of the present application.

LIST OF REFERENCE NUMERALS mounting base 10; notch 10*a*; substrate 101; first mounting part 102; second mounting part 103; third mounting part

104; roller brush frame 20; end plate 201; connecting plate 202; support beam 203; hooking part 204; connecting shaft 205; first roller brush 30'; second roller brush 30"; adjusting mechanism 40; cam 41; first motor 42; first connecting rod 43; elastic element 44.

DETAILED DESCRIPTION OF THE DISCLOSURE

The embodiments in the present application may be combined with each other. The detailed description in the specific embodiments should be understood as an explanation of the purpose of the present disclosure, and should not be construed as limiting the present disclosure.

Figure 4:
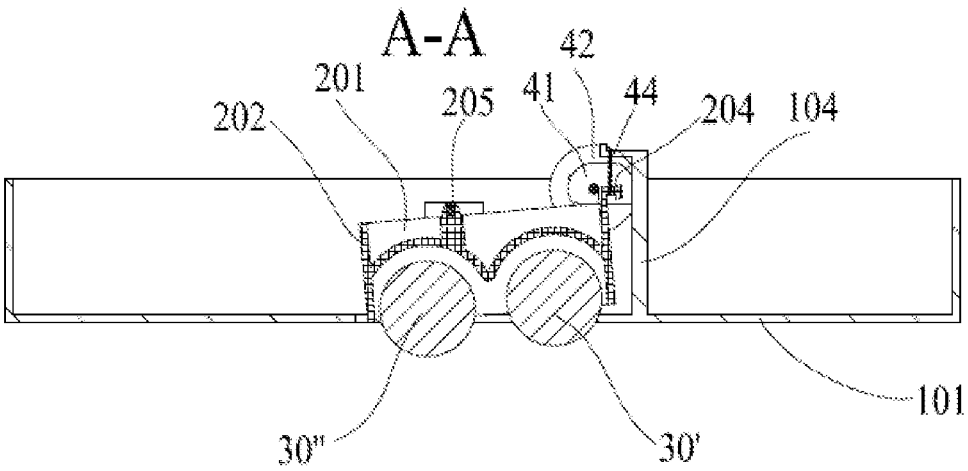
FIG. 4 is a cross-sectional view along a direction A-A as shown in FIG. 3, and the cleaning device is in a sweeping mode.

In the description of the present disclosure, the orientation or position relationships indicated by the terms "upper", "lower", "left", "right", "front" and "back" should be understood based on the orientation or position relationships as shown in FIG. 4. It should be understood that these orientation terms are only for the convenience of describing the present disclosure and simplifying the description, and do not indicate or imply that the specified device or element may have a specific orientation and may be constructed and operated in the specific orientation, so that it should not be construed as limiting the present disclosure.

Figure 3:
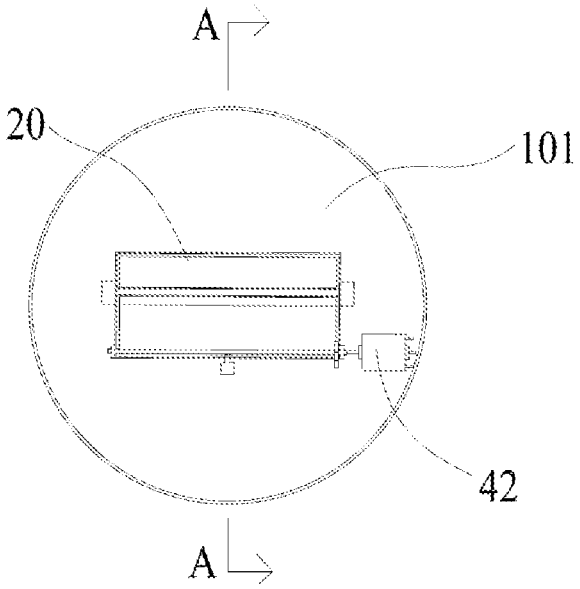
FIG. 3 is a top view of the structure as shown in FIG. 1.
Figure 5:
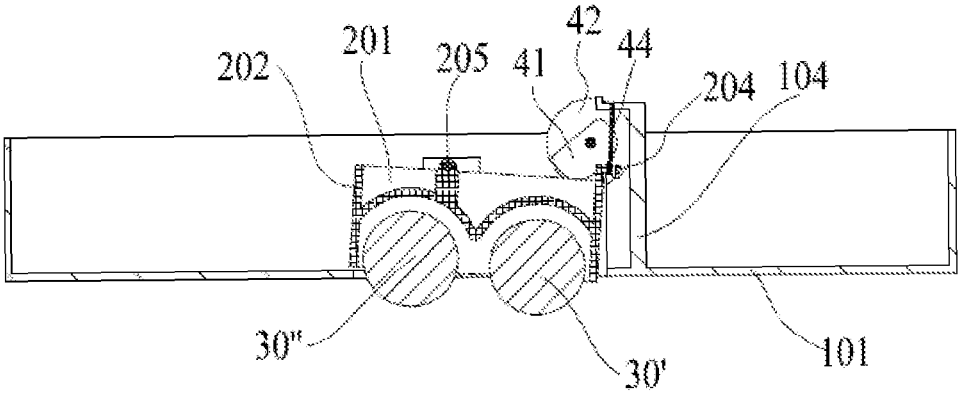
FIG. 5 is a cross-sectional view along a direction A-A as shown in FIG. 3, and the cleaning device is in another sweeping mode.

It should be noted that the top views of the cleaning device in different states are the same. FIG. 4 and FIG. 5 are cross-sectional views of the cleaning device as shown in FIG. 3 in different states along a direction A-A.

Figure 2:
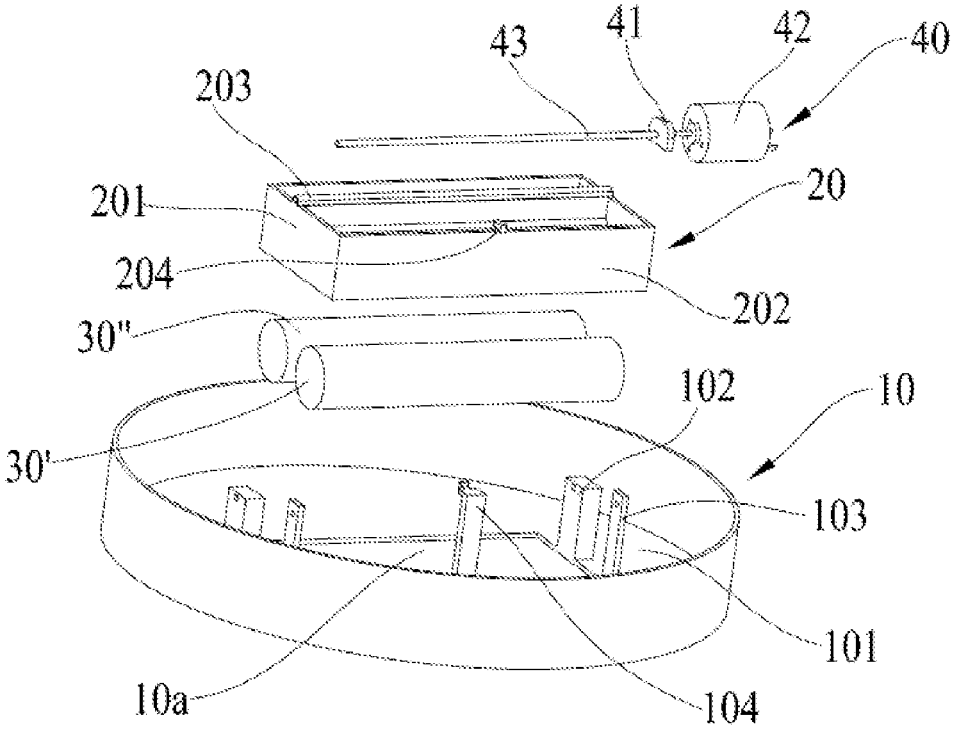
FIG. 2 is an exploded view of the structure as shown in FIG. 1.

The first aspect of the embodiments of the present application provides a roller brush component of a cleaning device. Referring to FIG. 1 and FIG. 2, the roller brush component includes a mounting base 10, a roller brush frame 20, an adjusting mechanism 40, a first roller brush 30' and a second roller brush 30". A notch 10*a* is formed on one side of the mounting base 10. The roller brush frame 20 is rotatablely connected with the mounting base 10. The adjusting mechanism 40 is in driving connection with the roller brush frame 20. The first roller brush 30' and the second roller brush 30" are connected with the roller brush frame 20, the first roller brush 30' and the second roller brush 30" are positioned in the notch 10*a*, and the first roller brush 30' and the second roller brush 30" may have different ground clearances during rotation of the roller brush frame 20.

The "ground clearance" refers to the minimum distance between the outer surface of a roller brush and a reference plane when the cleaning device is placed on the reference plane.

It should be noted that the expression "the first roller brush 30' and the second roller brush 30"" may have different ground clearances during rotation of the roller brush frame 20" means that the condition that the first roller brush 30' and the second roller brush 30" may have different ground clearances during rotation of the roller brush frame 20 may occur, but it does not In one embodiment mean that the first roller brush 30' and the second roller brush 30" always have different ground clearances. In other words, it does not exclude the condition that the first roller brush 30' and the second roller brush 30" have the same ground clearance during rotation of the roller brush frame 20.

The roller brush component according to the embodiments of the present application is not limited to be provided with two roller brushes and may also be provided with more roller brushes.

Under the condition that the roller brush component according to the embodiments of the present application needs to clean different environmental media, the adjusting mechanism 40 drives the roller brush frame 20 to rotate by an amplitude, and the roller brush frame 20 drives the first roller brush 30' and the second roller brush 30" to rotate together until the roller brush matched with the current environmental medium is in contact with the ground.

The materials of the first roller brush 30' and the second roller brush 30" may be configured according to actual conditions. For example, the first roller brush 30' may be formed as a hard-bristle roller brush configured to scrape dirt in carpets by virtue of a larger action force, and the materials of the bristles of the hard-bristle roller brush may be one or more of PE (polyethylene), nylon, PP (Polypropylene), sisal and PVC (Polyvinyl chloride). The second roller brush 30" is formed as a soft-bristle roller brush configured to wipe dust and hair scattering on floors without damaging the floors, and the materials of the bristles of the soft-bristle roller brush may be one or more of hair (human hair or animal hair), viscose velvet, nylon velvet, imported velvet, acrylic velvet and cotton velvet.

Taking an example of cleaning floors and carpets, when the floors need to be cleaned, referring to FIG. 4, the adjusting mechanism 40 drives the roller brush frame 20 to rotate until the second roller brush 30" is in contact with the ground to use the second roller brush 30" to clean the floors, and this state is a floor sweeping mode; and when the carpets need to be cleaned, referring to FIG. 5, the adjusting mechanism 40 drives the roller brush frame 20 to rotate until the first roller brush 30' is in contact with the ground to use the first roller brush 30' to clean the carpets, and this state is a carpet sweeping mode. Therefore, the sweeping modes are conveniently switched without manual replacement operations such as disassembly and installation.

It can be understood that the adjusting mechanism 40 may be automatically controlled or manually controlled.

The first roller brush 30' and the second roller brush 30" are arranged in parallel, and the center line of rotation of the roller brush frame 20 is parallel to the axis of the first roller brush 30' or the second roller brush 30". It can be understood that the parallel arrangement of the first roller brush 30' and the second roller brush 30" means that the axis of the first roller brush 30' is parallel to the axis of the second roller brush 30". Therefore, when the roller brush frame 20 rotates as needed, the first roller brush 30' and the second roller brush 30" are always able to remain substantially parallel to the reference plane.

The adjusting mechanism 40 is capable of driving the roller brush frame 20 to rotate and holding the roller brush frame 20 at a required position.

In the present embodiment, referring to FIG. 1, FIG. 4 and FIG. 5, The adjusting mechanism 40 includes an elastic element 44 and a cam 41 which are positioned at one side of the center line of rotation of the roller brush frame 20. The elastic element 44 is connected between the roller brush frame 20 and the mounting base 10. In one embodiment, one end of the elastic element 44 is connected with the roller brush frame 20, the other end of the elastic element 44 is connected with the mounting base 10, and the elastic element 44 applies a torque along a first direction to the roller brush frame 20; the cam 41 is in sliding contact with the roller brush frame 20, and the cam 41 applies a torque along a second direction opposite to the first direction to the roller brush frame 20; and the rotation amplitude of the roller brush frame 20 is adjusted by the cooperation of the elastic element 44 and the cam 41.

The elastic element 44 may be a spring or a rubber band.

When the elastic element 44 is an extensible elastic element, such as an extension spring or a rubber band, the extensible elastic element bears tensile stress, and the elastic element 44 and the cam 41 are disposed at the same side of the roller brush frame 20 in a position in contact with the cam 41. For example, the elastic element 44 and the cam 41 are disposed at the upper side or lower side of the orientation as shown in FIG. 4. When the elastic element 44 is a compressible elastic element, such as a compression spring, the compressible elastic element bears compressive stress, and the elastic element 44 and the cam 41 are disposed at two opposite sides of the roller brush frame 20 in a position in contact with the cam 41. For example, the elastic element 44 and the cam 41 are disposed at opposite upper and lower sides of the orientation as shown in FIG. 4.

Referring to FIG. 4, in the present embodiment, under the conditions that the elastic element 44 is the extensible elastic element and the elastic element 44 and the cam 41 are disposed at the upper side of the roller brush frame 20, the elastic element 44 always applies a first action force in a upward direction in FIG. 4 to the roller brush frame 20, and the first action force acts on the roller brush frame 20 to form a torque along a counterclockwise first direction in FIG. 4 with the center line of rotation of the roller brush frame 20 as an origin; and the cam 41 always applies a second action force along the in a downward direction in FIG. 4 to the roller brush frame 20, and the second action force acts on the roller brush frame 20 to form a torque along a clockwise second direction in FIG. 4 with the center line of rotation of the roller brush frame 20 as an origin. The rotation amplitudes of the roller brush frame 20 are different according to different rotation amplitudes of the cam 41, that is, the rotation amplitude of the roller brush frame 20 depends on the rotation amplitude of the cam 41.

Taking the state of the roller brush component as shown in FIG. 4 as the current state, in this state, the first roller brush 30' is off the ground, and the second roller brush 30" is in contact with the ground. This state is a floor sweeping mode, that is, the floors are cleaned by the second roller brush 30". In the state as shown in FIG. 4, the cam 41 is counterclockwise rotated, the roller brush frame 20 is clockwise rotated to be in the state as shown in FIG. 5, the first roller brush 30' is in contact with the ground, and the second roller brush 30" is off the ground, that is, the carpets are cleaned by the first roller brush 30'. This state is a carpet sweeping mode, and the ground clearance of the first roller brush 30' may be controlled by controlling the rotation amplitude of the cam 41 to adjust the strength of the scraping of the first roller brush 30' applied on the carpets.

In order to facilitate the rotation control of the cam 41, in the present embodiment, referring to FIG. 2, the roller brush component includes a first motor 42 and a first connecting rod 43, the first motor 42 is in driving connection with the first connecting rod 43 to drive the first connecting rod 43 to rotate, the cam 41 is fixedly connected with the first connecting rod 43, and the first connecting rod 43 is driven by the first motor 42 to drive the cam 41 to synchronously rotate. In the present embodiment, the axis of the first motor 42 and the axial direction of the first connecting rod 43 are substantially perpendicular to the height direction of the cleaning device. Therefore, under the condition that the height of the cleaning device is not increased, the first motor 42 and the first connecting rod 43 may be compactly arranged to ensure that the cleaning device has a compact structure.

The position of the roller brush frame 20 in rotational connection with the mounting base 10 is not limited. For example, the roller brush frame 20 may be rotatablely connected with the mounting base 10 coaxially along two axial ends of the first roller brush 30' and/or the second roller brush 30", or one position on the roller brush frame 20 may be rotatablely connected with the mounting base 10.

The structural shape of the mounting base 10 is not limited as long as a mounting space is provided for the roller brush frame 20 and the adjusting mechanism 40. In the present embodiment, referring to FIG. 1 and FIG. 2, the mounting base 10 includes a substrate 101, two first mounting parts 102, two second mounting parts 103 and a third mounting part 104. A notch 10*a* is formed on the substrate 101, the first mounting parts 102, the second mounting parts 103 and the third mounting part 104 are disposed at the first side of the substrate 101, and the first side of the substrate 101 is positioned inside the cleaning device. The two first mounting parts 102 are positioned at two axial ends of the first roller brush 30' and/or the second roller brush 30", and two opposite ends of the roller brush frame 20 are rotatablely supported on the first mounting parts 102. The two second mounting parts 103 are also positioned at two axial ends of the first roller brush 30' and/or the second roller brush 30", and the first connecting rod 43 is rotatablely supported on the two second mounting parts 103. The third mounting part 104 is disposed at one side of the second mounting parts 103 away from the first mounting parts 102, and one end of the elastic element 44 is connected, for example hooked, with the third mounting part 104.

The structure of the roller brush frame 20 is not limited as long as a mounting space is provided for the first roller brush 30' and the second roller brush 30" without interfering with the cleaning work of the first roller brush 30' and the second roller brush 30". Referring to FIG. 1 and FIG. 2, the roller brush frame 20 includes a support beam 203, two end plates 201 and connecting plates 202 connected between the two end plates 201. The two end plates 201 are positioned at two axial ends of the first roller brush 30' and/or the second roller brush 30", and the two axial ends of the first roller brush 30' and the second roller brush 30" are connected with the corresponding end plates 201, that is, the first roller brush 30' and the second roller brush 30" are clamped between the two end plates 201. The connecting plates 202 are connected between the two end plates 201 to enhance the structural strength of the roller brush frame 20. One or more connecting plates 202 may be provided. In the present embodiment, a plurality of connecting plates 202 are provided, and the plurality of connecting plates 202 and the two end plates 201 together enclose a containing cavity for containing the first roller brush 30' and the second roller brush 30", to avoid other structures of the cleaning device from interfering with the cleaning work of the first roller brush 30' and the second roller brush 30".

A support beam 203 is disposed at the top of the end plates 201 away from the notch 10*a*, and a through hole extending along an axial direction of the first roller brush 30' and/or the second roller brush 30" is formed in the support beam 203. The roller brush component includes a connecting shaft 205, the connecting shaft 205 is penetrated in the through hole, and two axial ends of the connecting shaft 205 are supported on the mounting base 10. In the present embodiment, the two axial ends of the connecting shaft 205 are supported on the two first mounting parts 102. The structure of the support beam 203 increases the contact area between the roller brush frame 20 and the connecting shaft 205, so that the rotational stability of the roller brush frame 20 may be increased, and the shaking of the roller brush frame 20 during rotation may be avoided to the greatest extent.

Further, in order to facilitate connection with the elastic element 44, a hooking part 204 is formed at one side of the connecting plate 202 away from the first roller brush 30' and the second roller brush 30", one end of the elastic element 44 is hooked with the hooking part 204, and the other end of the elastic element 44 is hooked with the third mounting part 104.

In an embodiment not shown, different from the above embodiments, the adjusting mechanism 40 includes a second motor and a second connecting rod, the second connecting rod is in driving connection with the second motor, the second connecting rod is rotatablely supported on the mounting base 10, the roller brush frame 20 is fixedly connected with the second connecting rod, the second connecting rod is driven by the second motor to drive the roller brush frame 20 to synchronously rotate, and the roller brush frame 20 is rotatablely connected with the mounting base 10 by the second connecting rod.

The second aspect of the embodiments of the present application provides a cleaning device. The cleaning device includes any one of the above roller brush components.

The cleaning device also includes a control device and an identification device configured to identify the cleaning environment. The cleaning environment includes carpets and flat interfaces, such as floors and ceramic tiles. The identification device can adopt an image processing technology for detection. For example, the carpets and the flat interfaces may be identified based on a convolutional neural network, and the description thereof is omitted herein.

The control device is electrically connected with the identification device and the adjusting mechanism, and the control device controls the adjusting mechanism 40 to drive the roller brush frame 20 to rotate according to the identification result of the identification device. In one embodiment, when the identification device detects that the cleaning environment is a flat interface, the control device controls the adjusting mechanism 40 to drive the roller brush frame 20 to rotate to be in the state as shown in FIG. 4, the first roller brush 30' is off the ground, and the second roller brush 30" is in contact with the ground, so that the second roller brush 30" is used for sweeping the flat interface; and when the identification device detects that the cleaning environment is a carpet, the control device controls the adjusting mechanism 40 to drive the roller brush frame 20 to rotate to be in the state as shown in FIG. 5, the first roller brush 30' is in contact with the ground, and the second roller brush 30" is off the ground, so that the first roller brush 30' is used for scraping the carpet.

The type of the cleaning device is not limited. For example, the cleaning device includes, but is not limited to, a sweeping robot.

What is claimed is:

1. A roller brush component of a cleaning device, comprising:

a mounting base, a notch being formed on a first side of the mounting base;

a roller brush frame, the roll brush frame being rotatablely connected with the mounting base;

an adjusting mechanism, the adjusting mechanism being in driving connection with the roller brush frame to drive the roller brush frame to rotate; and a first roller brush and a second roller brush, the first roller brush and the second roller brush being connected with the roller brush frame, the first roller brush and the second roller brush being positioned in the notch; and the roller brush frame, the first roller brush and the second roller brush being configured such that the first roller brush and the second roller brush have different ground clearances during rotation of the roller brush frame;

wherein the adjusting mechanism comprises an elastic element and a cam which are positioned at a first side of a center line of rotation of the roller brush frame, the elastic element is connected between the roller brush frame and the mounting base, the elastic element applies a torque along a first direction to the roller brush frame, the cam is in sliding contact with the roller brush frame, the cam applies torque along a second direction to the roller brush frame, and the first direction is opposite to the second direction.

2. The roller brush component of claim 1, wherein the first roller brush and the second roller brush are arranged in parallel, and the center line of rotation of the roller brush frame is parallel to an axis of the first roller brush.

3. The roller brush component of claim 1, wherein the first roller brush is formed as a hard-bristle roll brush, and the second roller brush is formed as a soft-bristle roll brush.

4. The roller brush component of claim 1, wherein the roller brush component comprises a first motor and a first connecting rod, the first connecting rod is in driving connection with the first motor, and the cam is fixedly connected with the first connecting rod.

5. The roller brush component of claim 4, wherein the adjusting mechanism comprises a second motor and a second connecting rod, the second connecting rod is in driving connection with the second motor, and the roller brush frame is fixedly connected with the second connecting rod.

6. The roller brush component of claim 1, wherein the elastic element is a spring or a rubber band.

7. The roller brush component of claim 1, wherein the roller brush frame comprises a support beam, two end plates and connecting plates connected between the two end plates, the two end plates are positioned at two axial ends of the first roller brush and/or the second roller brush, the support beam is disposed at a first side of the two end plates away from the notch, a through hole extending along an axial direction of the first roller brush and the second roller brush is formed in the support beam, the roller brush component comprises a connecting shaft, the connecting shaft is penetrated in the through hole, and two axial ends of the connecting shaft are supported on the mounting base.

8. A cleaning device, comprising:

a roller brush component of the cleaning device, comprising:

a mounting base, a notch being formed on a first side of the mounting base;

a roller brush frame, the roll brush frame being rotatablely connected with the mounting base;

an adjusting mechanism, the adjusting mechanism being in driving connection with the roller brush frame to drive the roller brush frame to rotate; and a first roller brush and a second roller brush, the first roller brush and the second roller brush being connected with the roller brush frame, the first roller brush and the second roller brush being positioned in the notch; and the roller brush frame, the first roller brush and the second roller brush being configured such that the first roller brush and the second roller brush have different ground clearances during rotation of the roller brush frame;

wherein the adjusting mechanism comprises an elastic element and a cam which are positioned at a first side of a center line of rotation of the roller brush frame, the elastic element is connected between the roller brush frame and the mounting base, the elastic element applies a torque along a first direction to the roller brush frame, the cam is in sliding contact with the roller brush frame, the cam applies torque along a second direction to the roller brush frame, and the first direction is opposite to the second direction.

9. The cleaning device of claim 8, wherein the cleaning device is a sweeping robot.

10. The cleaning device of claim 8, wherein the first roller brush is formed as a hard-bristle roll brush, and the second roller brush is formed as a soft-bristle roll brush.

11. The cleaning device of claim 8, wherein the roller brush component comprises a first motor and a first connecting rod, the first connecting rod is in driving connection with the first motor, and the cam is fixedly connected with the first connecting rod.

12. The cleaning device of claim 11, wherein the adjusting mechanism comprises a second motor and a second connecting rod, the second connecting rod is in driving connection with the second motor, and the roller brush frame is fixedly connected with the second connecting rod.

13. The cleaning device of claim 8, wherein the elastic element is a spring or a rubber band.

14. The cleaning device of claim 8, wherein the roller brush frame comprises a support beam, two end plates and connecting plates connected between the two end plates, the two end plates are positioned at two axial ends of the first roller brush and/or the second roller brush, the support beam is disposed at a first side of the two end plates away from the notch, a through hole extending along an axial direction of the first roller brush and the second roller brush is formed in the support beam, the roller brush component comprises a connecting shaft, the connecting shaft is penetrated in the through hole, and two axial ends of the connecting shaft are supported on the mounting base.

15. The cleaning device of claim 8, wherein the first roller brush and the second roller brush are arranged in parallel, and the center line of rotation of the roller brush frame is parallel to an axis of the first roller brush.

* * * * *